US006627370B2

(12) United States Patent
Tyagi et al.

(10) Patent No.: US 6,627,370 B2
(45) **Date of Patent: *Sep. 30, 2003**

(54) HARD CARRIER PARTICLES COATED WITH A POLYMER RESIN AND A CONDUCTIVE MATERIAL

(75) Inventors: Dinesh Tyagi, Fairport; Donna Anne DiPrima; James Hunter Anderson, both of Rochester, all of NY (US)

(73) Assignee: NexPress Solutions LLC, Rochester, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/096,985

(22) Filed: Jun. 12, 1998

(65) Prior Publication Data

US 2001/0002306 A1 May 31, 2001

Related U.S. Application Data

(63) Continuation-in-part of application No. 08/649,384, filed on May 17, 1996, now abandoned.
(60) Provisional application No. 60/005,511, filed on Sep. 28, 1995.

(51) Int. Cl.[7] ..... G03G 9/10
(52) U.S. Cl. ..... 430/111.33; 430/111.32; 430/137.13
(58) Field of Search ..... 430/106.6, 108, 430/110, 111, 137

(56) References Cited

U.S. PATENT DOCUMENTS

| | | | | |
|---|---|---|---|---|
| 3,738,970 A | * | 6/1973 | Cimino et al. | |
| 4,298,672 A | | 11/1981 | Lu | 430/110 |
| 4,323,634 A | | 4/1982 | Jadwin | 430/110 |
| 4,394,430 A | | 7/1983 | Jadwin et al. | 430/108 |
| 4,599,290 A | | 7/1986 | Yoerger et al. | 430/108 |
| 4,764,445 A | | 8/1988 | Miskinis et al. | 430/108 |
| 4,822,708 A | | 4/1989 | Machida et al. | 430/106.6 |
| 4,868,082 A | | 9/1989 | Kohri et al. | 430/106.6 |
| 4,902,596 A | | 2/1990 | Koishi et al. | 430/106.6 |
| 4,965,159 A | | 10/1990 | Kohno et al. | 430/108 |
| 5,071,726 A | | 12/1991 | Maniar | 430/106.6 |
| 5,093,201 A | | 3/1992 | Ohtani et al. | 428/407 |
| 5,102,769 A | * | 4/1992 | Creatura | 430/137 |
| 5,171,653 A | | 12/1992 | Jugle et al. | 430/108 |
| 5,212,034 A | | 5/1993 | Tsuyama et al. | 430/108 |
| 5,215,848 A | | 6/1993 | Ikeda et al. | 430/108 |
| 5,230,980 A | | 7/1993 | Maniar | 430/137 |
| 5,252,398 A | | 10/1993 | Ohtani et al. | 428/403 |
| 5,272,037 A | | 12/1993 | Ohtani et al. | 430/108 |
| 5,332,638 A | | 7/1994 | Creatura | 430/108 |
| 5,340,677 A | | 8/1994 | Baba et al. | 430/106.6 |
| 5,346,771 A | | 9/1994 | Kurahashi et al. | 428/447 |
| 5,500,320 A | | 3/1996 | Saha | 430/111 |

FOREIGN PATENT DOCUMENTS

| | | | | |
|---|---|---|---|---|
| JP | 1-134467 | | 5/1989 | 430/108 |
| JP | 2-210365 | * | 8/1990 | |

OTHER PUBLICATIONS

Grant, R. et al *Grant & Hackh's Chemical Dictionary*, 5th edition, McGraw–Hill Book Co, NY (1987), p. 541, 1987.*
Diamond, A.S. ed. *Handbook of Imaging Materials,* Marcel Dekker, Inc., New York (1991), pp 169, 182, and 183, 1991.*
Patent & Trademark Office English–Language Translation of Japanese Patent 2–210365 (Pub 8/90).*
Patent & Trademark English–Language Translation of JP 1–134467 (Pub 5/89).*
Plastics Additives Technical Bulletin, Aug. 1966, American Cyanamid Company.

* cited by examiner

*Primary Examiner*—Janis L. Dote
(74) *Attorney, Agent, or Firm*—Laurence P. Kessler

(57) ABSTRACT

There is provided a carrier, for an electrcostatographic developer, comprising particles of a hard magnetic ferrite material as the core, the core having a coating of a polymer resin, said resin in turn having a coating of an organic conductive material. The organic conductive material can be a charge control agent and can be present in very small amounts. The developer compositions have no need for preconditioning since they have stable charging characteristics. Further, they exhibit low levels of "dusting".

11 Claims, No Drawings

HARD CARRIER PARTICLES COATED WITH A POLYMER RESIN AND A CONDUCTIVE MATERIAL

CROSS-REFERENCE TO RELATED APPLICATIONS

This is a continuation-in-part application of Ser. No. 08/649,384 filed May 17, 1996, now abandoned, entitled "Hard Carrier Particles Coated With a Polymer Resin and a Conductive Material" and claims priority from Provisional Application Serial No. 60/005,511, filed Sep. 28, 1995.

FIELD OF THE INVENTION

The present invention relates to electrostatography. More particularly, it relates to the carrier particles that are used in two-component developers.

BACKGROUND OF THE INVENTION

In electrostatography, an electrostatic charge image is formed on a dielectric surface, typically the surface of a photoconductive recording element or photoconductor. Development of this image is commonly achieved by contacting it with a dry, two-component developer comprising a mixture of pigmented resinous electrically insulative particles known as toner, and magnetically attractable particles, known as carrier.

The carrier particles serve as sites against which the non-magnetic toner particles can impinge and thereby acquire a triboelectric charge. The toner particles are held on the surface of the relatively larger-sized carrier particles by the electric force generated by the friction of both particles as they impinge upon and contact one another during mixing interactions.

During contact between the electrostatic image and the developer mixture, the toner particles are stripped away from the carrier particles to which they had formerly adhered (via triboelectric forces) by the relatively strong attractive force of the electric field formed by the charge image which overcomes the bonding forces between the toner particles and the carrier particles. In this manner, the toner particles are attracted by the electrostatic forces associated with the charge image and deposited on the electrostatic image to render it visible.

Conventionally, carrier particles made of soft magnetic materials have been employed to carry and deliver the toner particles to the electrostatic image. This "soft" carrier is typically unoxidized or partially oxidized iron or steel powder. Carriers of this type suffer from various problems such as charge instability, relative humidity performance and resistance change and other problems. For example, as the developer is used, the carrier surface changes due to either the toner particles adhering to the surface of the soft carrier, referred to in the art as "carrier scumming", or due to the breaking or brittle fracture of the iron oxide off the surface of the carrier particles.

It is known in the art to incorporate charge control agents onto the surface of soft magnetic carrier particles. Reference is made, for example, to U.S. Pat. Nos. 5,215,848; 5,171,653; 5,230,980; 4,868,082; 5,340,677; and 5,346,771. A typical reason for incorporating charge control agents in this type of carrier is to lower the initially high charge observed with the developer system.

After aging of the developer by the repeated cycling of the developer, there is essentially no difference between the disteryl ammonium methyl sulfate treated and untreated carriers described in the '653 patent. More recently, hard magnetic materials have been used to carry and deliver the toner particles to the electrostatic image. Many of the problems encountered with the "soft" type of particle are solved with the "hard" ferrites as carriers. However, because the magnetic attraction between the permanent magnetic core and the permanently magnetic hard ferrite carrier is so high, the developer station has to be significantly modified. In the case of soft ferrites and iron oxide powder carriers, the developer station shell is rotated around a fixed magnetic core. When developers based on hard ferrite carrier particles are used, the magnetic core of the development roller, which contains between 4 to 30 magnetic material arranged sequentially in north-south pole alignment, is rotated. This causes the chains of the magnetic carrier particles, which form the development brush, to flip end-to-end at very high rates. In other words, it is well recognized that the hard magnetic material carriers are not analogous to the soft carrier materials.

U.S. Pat. No. 4,546,060 to Miskinis et al, and U.S. Pat. No. 4,473,029 to Fritz et al, teach the use of hard magnetic materials as carrier particles and an apparatus for the development of electrostatic images utilizing such hard magnetic carrier particles, respectively. These patents require that the carrier particles comprise a hard magnetic material, meaning a magnetic material exhibiting a coercivity of at least 300 Oersteds when magnetically saturated and an induced magnetic moment of at least 20 EMU/g when in an applied magnetic field of 1000 Oersteds. The terms "hard" and "soft" when referring to magnetic materials have the generally accepted meaning as indicated on page 18 of *Introduction to Magnetic Materials* by B. D. Cullity published by Addison-Wesley Publishing Company, 1972.

The biggest impact of the use of hard ferrite carrier particles is that extremely high mechanical agitation takes place as the core of the development shell is rotated. Unlike the case with soft carriers which have no flipping of the carrier chains, the number of developer chain flips can range between 5,000 to 25,000 flips per minute when using hard ferrite carriers. Due to this high mechanical agitation, the aging of the developer takes place at a very rapid rate.

The developer aging is characterized by the loss of charge in the developer which causes dusting of the toner from the development shell due to high centrifugal force as well as increase in image density and image fog. It is to a solution to this problem that the present invention is directed.

SUMMARY OF THE INVENTION

In accordance with the present invention, there is provided a carrier, for an electrcostatographic developer, comprising particles of a hard magnetic ferrite material as the core, the core having a coating of a polymer resin, said resin in turn having a coating of an organic conductive material.

The developer compositions of the invention have several advantages. They exhibit no need for preconditioning; a longer developer life in that the charge to mass ratio does not change significantly over an extended period, e.g. 100,000 copies in an electrophotographic copying machine. In addition, the developer is less prone to "dusting". This implies that the electrostatic forces that hold the toner to the carrier surface is sufficient to substantially prevent the formation of toner dust in the copying machine. Still further, the charging rate, where the term "charging rate" is used to describe how rapidly a toner added to developer equilibrates to its highest charge, is increased. As a result of these properties, there is a consistently high image quality achieved for long periods when using the developers of the invention.

DETAILED DESCRIPTION OF THE INVENTION

The compositions of the invention have three essential components. First is the hard ferrite magnetic carrier particles. These particles are coated with a polymeric resin to control the triboelectric charging. The final component is a organic conductive material coating on the polymeric resin. Except for the organic conductive material coating, the hard magnetic carrier particles coated with resin are known in the art. It has been found that incorporation of small levels of organic conductive materials on the surface of the polymeric resin coating the particles improves the charge stability of electrcostatographic developers and other properties. Incorporation of organic conductive material on the carrier surfaces can be achieved by solution coating methods. As described in more detail below, a solution of a organic conductive material is prepared in a solvent such as methanol, water or isopropyl alcohol etc. The solution is added to the carrier which has been previously coated with desired amounts of a polymer resin to ensure correct triboelectric charging for toner; the solvent is then removed leaving the coating of the organic conductive material on the resin. Other methods for forming the coating may also be useful.

Representative hard carrier particles include magnetic material gamma ferric oxides and the hard ferrites compounds of barium and/or strontium such as, $BaFe_{12}O_{19}$ and $SrFe_{12}O_{19}$ disclosed in U.S. Pat. No. 4,042,518. Another hard ferrite magnetic material has the formula $MO.6Fe_2O_3$ where M is strontium, barium or mixtures thereof. Hard ferrite particles are commercially available from Powdertech Co.

The carrier particles of this invention, with the exception of the conductive coating, are prepared by conventional procedures that are well known in the art of making ferrites. Suitable procedures are described, for example, in U.S. Pat. Nos. 3,716,630, 4,623,603, and 4,042,518; K. Master, "Spray Drying Handbook", George Godwin Limited, London, 1979, and "Ferromagnetic Materials" Volume 3 edited by E. P. Wohlfarth and published by North Holland Publishing Company, Amsterdam, N.Y., page 315 et seq. The term "green beads" is a term that is used to describe uncoated and unprocessed hard ferrite particles. Spray drying is the most commonly used technique to manufacture green beads. This technique is described in previously mentioned K. blasters, "Spray Drying Handbook," George Godwin Limited, London, 1979, which is hereby incorporated by reference.

Generally, a ball milling device which utilizes stainless steel balls is used to mix the ferrite-forming starting materials in slurry form. However, the ferrite-forming starting materials may be mixed in sluiry form in any one of a number of types of equipment such as a vibrating pebble mill, a high speed stirrer with counter turning rotor and blades, an impeller mixer, a high speed dispersator, a high speed mixer or other conventional mixing equipmrnent in lieu of a ball milling device. The actual degree of mixing achieved may be controlled by the choice of equipment used and the selection of specific equipment operating parameters and/or slurry conditions such as mixing speed, mixing time, viscosity and temperature. Where it is desired to obtain controlled particle size reduction during the mixing operation, then the choice of equipment will generally predominate. In the case of a ball milling device, a smooth, homogeneous slurry is generally formed after approximately 12 hours of agitation depending on the equipment capacity and the size of the batch prepared. Following the milling operation, it is generally preferred to screen the slurries prior to spray drying in order to eliminate any large, solid particles which may be present as would plug the atomizer.

A spray dryer designed for either spray nozzle atomization or spray machine-disc atomization or equivalent may be employed to dry the slurry of ferrite-forming starting materials. A particularly desirable type of spray machine is one that is essentially a closed pump impeller driven by a variable speed drive and is commonly termed a spinning atomizer, disc or wheel. A Niro Atomizer or Niro Spray Dryer (disc type) is especially useful.

Prior to firing the ferrite-forming green beads to obtain the ferrite carrier particles of the invention, the green beads are classified to obtain only that fraction of green beads having a number average particle diameter of from 10.0 to 38.0 micrometers. This insures that upon subsequent firing that only those ferrite carrier particles having a number average particle diameter of from 10.0 to 38.0 micrometers will be produced which is essential to the successful practice of the present invention. These are the "green beads" that are subsequently fired to produce hard ferrite particles useful in the invention.

"Number average particle size," as used herein, refers to the mean diameter of the particles as measured by a conventional particle size measuring device such as a Coulter Multisizer, sold by Coulter, Inc.

In order to prepare the magnetic carrier particles, the green beads are subsequently fired at high temperatures generally ranging from 900 to 1500° C. During the firing process, the individual particulates within the individual green beads react to produce the desired crystallographic phase. Thus, during the firing process, the individual unreacted ferrite-forming precursor components bound in the non-magnetic green bead react to form the magnetic carrier particles, which, like the green beads, are of substantially uniform particle size and substantially spherical shape. The organic binder is degraded and is not present in the magnetic carrier particles. The magnetic character of the carrier particle is primarily controlled by the chemical stoichiometry of the constituting ferrite-forming materials and the processing conditions of reaction time and temperature. For optimum carrier performance, it is important that the chemical composition of the green beads be maintained throughout the spray drying process. The disintegration of green beads can result in chemically heterogeneous green bead particles, which will lead to less than optimum chemical reactions during the firing process and inferior magnetic performance of the final product.

The ferrite carrier particles used in this invention exhibit a high coercivity of at least 300 Oersteds, typically about 1000 to 3000 Oersteds, when magnetically saturated and an induced magnetic moment of at least 20 EMU/g of carrier in an applied field of 1000 Oersteds. Preferred particles have an induced magnetic moment of about 30 to about 70 EMU/g of carrier in an applied field of 1000 Oersteds. The induced magnetic moment of the carrier particles is dependent primarily on the composition and concentration of the magnetic material in the particle. A high coercivity is desirable as it results in better carrier flow on the brush, which results in a higher charge on the toner and more delivery of the toner to the photoconductor, which in turn translates into higher development speeds. Mixtures of hard ferrite particles can also be used.

The coercivity of a magnetic material refers to the minimum external magnetic force necessary to reduce the induced magnetic moment from the remnance value to zero while it is held stationary in the external field and after the material has been magnetically saturated, i.e., the material has been permanently magnetized. A variety of apparatus and methods for the measurement of coercivity of the present carrier particles can be employed, such as a Princeton Applied Research Model 155 Vibrating Sample Magnetometer, available from Princeton Applied Research Co., Princeton, N.J. The powder is mixed with a non-magnetic polymer powder (90% magnetic powder: 10% polymer by weight). The mixture is placed in a capillary tube, heated above the melting point of the polymer, and then allowed to cool to room temperature. The filled capillary tube is then placed in the sample holder of the magnetometer and a magnetic hysteresis loop of external field (in Oersteds) versus induced magnetism (in EMU/g) is plotted. During this measurement, the sample is exposed to an external field of 0 to 10,000 Oersteds.

The hard ferrite carrier particles are coated with a polymer resin to better enable the carrier particles to triboelectrically charge the toner particles. The toner particles acquire an optimally high, net electrical charge because of the frictional contact of the toner particles and the resin coating. The high net charge reduces the amount of toner lost from the developer mix as it is agitated in the magnetic brush apparatus.

The polymer with which the carrier particles are coated can be any of a large class of thermoplastic polymeric resins. Especially desirable are fluorocarbon polymers such as poly(vinylidene fluorides and poly(vinylidene fluoride-co-tetra-fluoroethylene). Also useful are the copolymers of vinylidene chloride with acrylic monomers which are disclosed in U.S. Pat. No. 3,795,617. Other examples include cellulose esters such as cellulose acetate and cellulose acetate butyrate, polyesters such as poly(ethylene terephthalate) and poly(1,4-butanediol terephthalate), polyamides such as nylon and polycarbonates, polyacrylates and polymethacrylates. Still other examples include the thermosetting resins and light-hardening resins described in U.S. Pat. No. 3,632,512; the alkali-soluble carboxylated polymers of U.S. Pat. No. Re. 27,912 (Reissue of U.S. Pat. No. 3,547,822); and the ionic copolymers of U.S. Pat. No. 3,795,618 and 3,898,170. Currently preferred is a commercially available poly(vinylidene fluoride) available as KYNAR® polyvinylidene fluoride from Penwvalt Co. Another preferred polymer resin is poly(methyl methacrylate) (PMMA). Commercially available PMMA include SOKEN® MP 201 poly(methyl methacrylate) from Soken Co. Mixtures of resins can also be used, particularly mixtures of KYNAR® polyvinylidene fluoride and PMMA.

In coating the ferrite carrier particles with resin, the carrier particles are mixed with finely-divided powdered resin. The particle size of the powdered resin can vary considerably but should be smaller than the particle size of the carrier particles. The resin particles can range in average diameter from 0.01 to 5.0 micrometers. The commercially available materials noted above meet these criteria.

The amount of resin powder relative to the amount of carrier particles can vary over a considerable range, but preferably, is from about 0.05 to 5 weight percent. The preferred range is 0.5 to 2 weight percent.

To dry-mix the carrier particles and resin particles, they preferably are tumbled together in a rotating vessel. This dry mixing should continue preferably for several minutes, e.g., for 5 to 30 minutes. Other methods of agitation of the particles are also suitable, e.g., mixing in a fluidized bed with an inert gas stream, or mixing by a mechanical stirrer.

After dry mixing the carrier particles and resin powder as described, the resin is bonded to the carrier particles, for example, by heating the mixture in an oven at a temperature and for a time sufficient to achieve bonding. The temperature depends on the polymer resin used. With the preferred resins, the temperature is typically between about 190 and 260° C.

The polymer resin is then coated, in accordance with the present invention, with a organic conductive material. Useful organic conductive materials include conductive charge control agents and antistatic agents. By "organic conductive material" it is meant compositions which have a bulk resistivity of less than about $10^{10}$ Ω-cm. Bulk resistivity can be conveniently measured using a static voltaic cell. A wide variety of organic materials meet this criteria. Many of these materials are also charge control agents and the charge control agents which meet this criteria are the currently preferred organic conductive materials.

The amount of organic conductive material which provides good results ranges from about 50 to 500 ppm (parts per million) by weight of the combined hard magnetic ferrite material and polymer resin coating. Lower amounts can provide for less than the desired effects. Higher amounts can sometimes affect the function of the polymer resin to control the triboelectric properties. That is, the charge to mass ratio begins to be adversely affected at higher amounts. The best results are achieved when the carrier has been coated with about 200 ppm to 350 ppm of organic conductive material.

A large number of conductive charge control agents have been examined so far for use as the organic conductive material. It will be understood that not all of the charge control agents described in the following references will meet the conductivity requirement but many will and useful compositions can be selected by simply measuring the bulk resistivity using conventional techniques. Useful conductive charge control agents can be selected from those described in the following references (mixtures of materials can also be used):

U.S. Pat. No. 4,394,430 to Jadwin et al describes a charge control agent which is a quaternary ammonium salt of the formula:

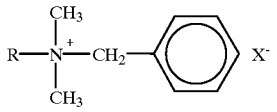

where R is 12 to 24 carbon alkyl and X is an anion.

U.S. Pat. No. 3,893,935 to Jadwin et al describes a charge control agent which is a quaternary ammonium salt of the formula:

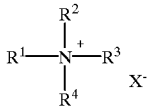

where $R^1$, $R^2$, $R^3$, and $R^4$ are 1–7 carbon alkyl and X is in anion.

U.S. Pat. No. 4,323,634 describes a charge control agent which is a quaternary salt of the formula:

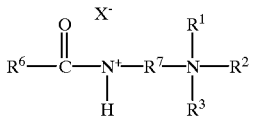

wherein $R^1$, $R^2$ and $R^3$ are the same or different C8–C30, alkyl groups;

$R^6$ is an alkyl group having 7 or more carbon atoms;

$R^7$ is a straight chain alkylene group having from 1 to about 8 carbon atoms; and X— is a halide ion or an organosulfur-containing anion of the formula $R^5SO_n$ wherein $R^5$ is an aliphatic or aromatic group having up to about 10 carbon atoms and n is 3 or 4.

U.S. Pat. No. 4,298,672 to Lu teaches a charge control agent which is an alkyl pyridinium compound or its hydrate of the formula:

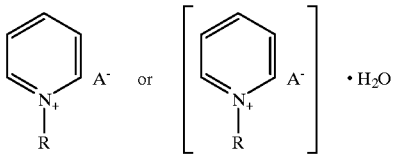

where R is 15–18 carbon hydrocarbon and A is Cl or Br.

U.S. Pat. No. 5,304,449 to Hollenbaugh, Jr., teaches charge enhancing components (1) alkyl pyridinium compounds or their hydrates and (2) tetrasubstituted ammonium salts.

A significant improvement in the developer stability and dusting levels was observed with charge control agents lauramidopropyl trimethyl ammonium methyl sulfate (CATANAC® LS and SN, CYASTAT® LS ), cetyl pyridinium chloride and dioctadecyl dimethyl ammonium chloride. These are the currently preferred organic conductive materials.

As discussed previously, the carrier particles of the invention are employed in combination with toner particles to form a dry, two-component developer composition. In use, the toner particles are electrostatically attracted to the electrostatic charge pattern on an element while the carrier particles remain on the applicator shell. This is accomplished in part by intermixing the carrier and toner particles so that the carrier particles acquire a charge of one polarity and the toner particles acquire a charge of the opposite polarity. The charge polarity on the carrier is such that it will not be electrically attracted to the electrostatic charge pattern. The carrier particles also are prevented from depositing on the electrostatic charge pattern because the magnetic attraction exerted between the rotating core and the carrier particles exceeds the electrostatic attraction which may arise between the carrier particles and the charge image.

Tribocharging of toner and hard magnetic carrier is achieved by selecting materials that are so positioned in the triboeleciric series to give the desired polarity and magnitude of charge when the toner and carrier particles intermix. If the carrier particles do not charge as desired with the toner employed, the carrier can be coated with a material which does. Such coating materials and methods have been previously described herein. The charging level in the toner generally is at least 10.0 to 30.0 microcoulombs per gram of toner weight, although charging levels of up to about 300 microcoulombs per gram of toner can be used. At such charging levels, the electrostatic force of attraction between toner particles and carrier particles is sufficient to disrupt the magnetic attractive forces between carrier particles, thus facilitating replenishment of the developer with fresh toner. How these charging levels are measured is described immediately below. The polarity of the toner charge can be either positive or negative.

The charging level or charge-to-mass ratio on the toner, Q/M, in microcoulombs/gram, is measured using a standard procedure in which the toner and carrier are placed on a horizontal electrode beneath a second horizontal electrode and are subjected to both an AC magnetic field and a DC electric field. When the toner jumps to the other electrode change in the electric charge is measured and divided by the weight of toner that jumped. It will be appreciated, in this regard, that the carrier will bear about the same charge as, but opposite in polarity to, that of the toner.

The developer is formed by mixing the particles with toner particles in a suitable concentration. Within developers of the invention, high concentrations of toner can be employed. Accordingly, the present developer preferably contains from about 70 to 99 weight percent carrier and about 30 to 1 weight percent toner based on the total weight of the developer; most preferably, such concentration is from about 75 to 99 percent carrier and from about to 1 weight percent toner.

The toner component of the invention can be a powdered resin which is optionally colored. It normally is prepared by compounding a resin with a colorant, i.e., a dye or pigment, and any other desired addenda. If a developed image of low opacity is desired, no colorant need be added. Normally, however, a colorant is included and it can, in principle, be any of the materials mentioned in Color Index, Vols. I and II, 2nd Edition. Carbon black is especially useful. The amount of colorant can vary over a wide range, e.g., from 3 to 20 weight percent of the polymer. Combinations of colorants may be used.

The mixture is heated and milled to disperse the colorant and other addenda in the resin. The mass is cooled, crushed into lumps and finely ground.

The resulting toner particles range in diameter from 3.0 to 20.0 micrometers.

The toner resin can be selected from a wide variety of materials, including both natural and synthetic resins and modified natural resins, as disclosed, for example, in the patent to Kasper et al, U.S. Pat. No. 4,076,857 issued Feb. 28, 1978. Especially useful are the crosslinked polymers disclosed in the patent to Jadwin et al, U.S. Pat. No. 3,938,992 issued Feb. 17, 1976, and the patent to Sadanatsu et al, U.S. Pat. No. 3,941,898 issued Mar. 2, 1976. The crosslinked or noncrosslinked copolymers of styrene or lower alkyl styrenes with acrylic monomers such as alkyl acrylates or methacrylates are particularly useful. Also useful are condensation polymers such as polyesters. The binder for most of the toners of the examples were made by a suspension polymerization technique described in U.S. Pat. No. 4,912,009. Toners of this type are commercially available from Eastman Kodak under the names: EKTAPRINT® LK; Eastman Kodak HX® Black, Blue, Red, Green, Brown and Yellow. The pigments found in these toners is shown in Table 1 below. Polyester binders are used in commercially avialable COLOREDGE® toners also available from Eastman Kodak Company.

Useful toners are also described in U.S. Ser. No. 08/253,447, filed Jun. 8, 1994 and entitled HUMIDITY STABILIZED TONERS AND DEVELOPERS, now abandoned. That application describes a toner which includes a certain combination of charge control agents. The first charge control agent is an agent described in U.S. Pat. No. 4,624,907 and the second charge control agent is described in U.S. Pat. No. 4,814,250. In the examples which follow, the toner composition described in "Preparation of Toner" in the '447 application, now abandoned, was used as the toner described as '447 in Table 1.

That toner was prepared by the following procedure:

A dry blend was prepared from 50.0 grams of poly (styrene-co-butyl acrylate-co-divinylbenzene) binder and 3.5 grams of REGAL 300™ (Carbon black (from Cabot Corp.), 1.25 grams of "T-77", an ammonium sodium salt of the hexadentate iron chelate of two molecules of 1-(2-hydroxy-5-chlorophenylazo)-2-hydroxy-3-naphthylamide (from Hodagaya Chemical Co.), and 0.5 grams of AERO-SOL OT-B® (from American Cyanamid), a mixture of 85 parts by weight of the sodium salt of di-octyl 2-sulfosuccinate and parts by weight of sodium benzoate. The dry blend was added to a heated two-roll compounding mill whose roller surfaces were set to 150° C. The melt was exercised on the mill for minutes, then removed and cooled. The resulting slab was first coarse ground to 2 mm size on a laboratory mill, the finely pulverized to approximately 12 micrometer size on a Trost TX jet mill. The toner thus prepared had a concentration of 2.5 parts per hundred of "T-77" and a concentration of 1 part per hundred of AERO-SOL OT-BO® per 100 parts of poly(styrene-co-butyl acrylate-co-divinylbenzene) binder.

The shape of the toner can be irregular, as in the case of ground toners, or spherical. Spherical particles are obtained by Spray drying a solution of the toner resin in a solvent. Alternatively, spherical particles can be prepared by the polymer bead swelling technique disclosed in European Pat. No. 3905 published Sept. 5, 1979, to J. Ugelstad.

The toners useful in the present invention can also be made with a process that is a modification of the evaporative limited coalescence process described in U.S. Pat. No. 4,883,060, the disclosure of which is hereby incorporated by reference. In that process, binder polymer is dissolved in a water immiscible organic solvent along with charge control agent and pigment if needed and then a water suspension of small droplets of the binder solution are dispersed in water with a stabilizer such as silica. The water immiscible organic solvent is then removed so as to produce a suspension of monodisperse spherical particles of the binder. The water is then removed and the toner composition recovered. The '060 patent discloses the use of a promoter and a silica stabilizer during the process. The silica can be removed by a KOH or HF wash. A polymeric latex can be used as a stabilizer and this is described in U.S. Pat. No. 4,965,131.

The toner can also contain minor components such as charge control agents, release agents and antiblocking agents. Especially useful charge control agents are disclosed in U.S. Pat. No. 3,893,935 and British Pat. No. 1,501,065. Quaternary ammonium salt charge agents are disclosed in Research Disclosure, No. 21030, Volume 210, October, 1981 (published by Industrial Opportunities Ltd., Homewell, Havant, Hampshire, P09 1EF, United Kingdom), are also useful. The toner can also be surface treated with small inorganic particles to impart powder flow or cleaning or imporved transfer.

As noted, the toner particles can have submicrometer particles appended to the surface of the marking toner particles so as to facilitate transfer. These submicrometer particles will be referred to as "transfer assisting particles" or "transfer assisting addenda." The transfer assisting particles typically are smaller than 0.4 $\mu$m. It is preferred that the transfer assisting particles are between about 0.01 and 0.2 $\mu$m, and it is most preferred that the transfer assisting particles are between about 0.05 and 0.1 $\mu$m. Preferred addenda are inorganic particles; however, organic particles can also be used. The addenda can assist transfer, as well as be present on the toner for other purposes, such as to affect the charging characteristics of the toner or to clean the imaging element. Methods of making these toners include dry blending the transfer assisting particles with the toner particles as disclosed in G.B. 2,166,881-A; and Japanese Kokai Nos. 63/256967, and 01/237561. The transfer assisting particles can also be embedded into the surface of the toner as disclosed in U.S. Pat. Nos. 4,950,573 and 4,900,647. Further, the marking toner having the transfer assisting particles adhered to their surfaces can be made from dispersions of the toner particles and the transfer assisting particles in aqueous or other liquids. Examples of transfer assisting particles include particles of silica, alumina, titanium oxide, barium titanate, magnesium titanate, calcium titanate, strontium titanate, zinc oxide, quartz sand, clay, mica, wollastonite, diatomaceous earth, chromium oxide, cerium, red oxide, antimony trioxide, magnesium oxide, zirconium oxide, barium sulfate, barium carbonate, calcium carbonate, silicon carbide and silicon nitride. A mixture of two or more different types and sizes of transfer assisting particles can be used. The transfer assisting particles can be treated before or after adhering to the toner particles. Examples of such treatments are disclosed in U.S. Pat. Nos. 5,412,019; 5,415,936; 5,418,103; 5,419,928 and JP 7,036,211. The more preferred transfer assisting particles include silica, alumina and titanium dioxide. The most preferred transfer assisting particules are finely powdered silica. The amount of the transfer assisting particles added to the toner is from 0.3 to 5.0 percent by weight based on the weight of the toner binder depending on the particle size distribution Additional examples of toners and methods of producing toners which are useful in this invention are included in EP Application 94110612.2; and U.S. Pat. Nos. 5,378,572; 5,278,018; 5,194,356; 5,192,637; 5,176,979; 5,178,984; 5,021,317; 5,093,220; 4,828,954; 5,362,593; 5,244,764 and 5,364,720. This list of references is not exhaustive. Toners having transfer assisting addenda are commercially available from Ricoh, Cannon and other toner suppliers.

During image development an electrostatic image is brought into contact with a magnetic brush comprising a rotating-magnetic core, an outer non-magnetic shell and a two-component, dry developer described above. The electrostatic image so developed can be formed by a number of methods such as by image-wise photodecay of a photoreceptor, or image-wise application of a charge pattern on the surface of a dielectric recording element. When photoreceptors are employed, such as in high-speed electrophotographic copy devices, the use of half tone screening to modify an electrostatic image can be employed, a combination of screening with development producing high-quality images exhibiting high $D_{max}$ and excellent tonal range. Representative screening methods including those employing photoreceptors with integral half-tone screens are disclosed in U.S. Pat. No. 4,385,823.

The following non-limiting examples further illustrate the invention.

EXAMPLES

The charge stability of an electrcostatographic developer composition comprising carrier particles according to the invention was determined. The developer contained (1) 10.0 percent by weight (12% by weight for the COLOREDGE® example) of toner having a number average particle diameter of about 12 micrometers and (2) the remainder, strontium ferrite carrier particles, having a number average particle diameter of 10.0 to 38.0 micrometers thinly melt coated with a polymer resin (0.94 percent by weight of the carrier particles of fluorocarbon resin KYNAR® 301F fluorocarbon polymer obtained from the Pennwalt Chemical Company and 0.56 percent by weight of the carrier particles of PMMA resin SOKEN® MP 201 poly(methyl methacrylate). The resulting carrier was solution coated with a organic conductive material.

Various coatings of organic conductive material on carrier particle surfaces were carried out by solution coating method. To illustrate, for Example 1, a 0.005 g of lauramidopropyl trimethylammonium methylsulfate organic conductive material was dissolved in approximately 10–12 mL methanol. The solution was then added slowly to grams of carrier particles that had been previously coated with desired level of polymeric resins as described. This corresponds to 200 ppm (parts per million by weight) of organic conductive material on the carrier surface. The mixture was stirred under an infra-red lamp to help drive off the methanol. The dry organic conductive material coated carrier was used as is for testing without any sieving. Other examples were prepared in a similar manner.

Larger batches of organic conductive material coated carriers were also prepared by mixing the organic conductive material solution and carrier by using mechanical mixers. In those cases the drying of carrier was carried out under dry nitrogen or warm air.

The amount of organic conductive material coated on the carrier surface was confirmed by determining the conductivity of a 80 mL methanol solution to which 4.4 g of carrier had been added. The mixture was allowed to sit for minutes and conductivity values then determined and measured in $\mu$S/cm.

A control developer was prepared for comparison It was the same as the above experimental developer except that the polymeric resin coated strontium ferrite carrier particles did not have any coating of organic conductive material.

The specific components of various toner compositions are shown in Table 1. The toner compositions are commercially available and have the indicated pigments. The specific components of various carrier compositions are shown in Table 2 and the results of testing is shown in Table 3. In the tables, the designation "C" indicates a comparative example, not within the scope of the invention.

Toner charge was then measured in microcoulombs per gram of toner ($\mu$c/g) in a "MECCA" device. Prior to measuring the toner charge, the developer was vigorously mixed to cause triboelectric charging by placing a 4 gram sample of the developer into a plastic vial, capping the vial and shaking the vial on a "wrist-action" robot shaker operated at about 2 Hertz and an overall amplitude of about 11 cm for 2 minutes. Toner charge level after shaking was measured for each sample by placing a 100 milligram sample of the charged developer in a MECCA apparatus and measuring the charge and mass of transferred toner in the MECCA apparatus. This involves placing the 100 milligram sample of the charged developer in a sample dish situated between electrode plates and subjecting it, simultaneously, for 30 seconds, to a 60 Hz magnetic field and an electric field of about 2000 volts/cm between the plates. The toner is released from the carrier and is attracted to and collects on the plate having polarity opposite to the toner charge. The total toner charge is measured by an electrometer connected to the plate, and that value is divided by the weight of the toner on the plate to yield the charge per mass of toner (Q/m). The toner charge level (i.e. charge-to-mass ratio) was also taken after exercising the developer for an additional 10 minutes by placing the magnetized developer in a glass bottle on top of a cylindrical roll with a rotating magnetic core rotating at 2000 revolutions per minute. The magnetic core had 12 magnetic poles arranged around its periphery, in an alternating north and south fashion. This closely approximates typical actual usage of the developer in an electrcostatographic development process. After this additional minute exercising, the toner charge was measured in a MECCA apparatus. The toner charge level was also measured after an additional 50 minutes (to give a one hour reading) of exercise and that value is reported in Table 3 as the I hour charge to mass ratio.

Table 3 also reports the "% Toner Wrong Signed". This refers to the percentage of total toner present in the initial developer which does not respond to the applied electric field because of its wrong sign character imparted to it as a result of the exercising.

The trimethylammonium methylsulfate charge agent coatings on negative carriers can be used to control the charge on the negative developers without increasing the presence of wrong signed toner particles.

TABLE 1

| Toner | Description | Pigment |
|---|---|---|
| 1 | EKTAPRINT ® K Toner | Cabot BLACK PEARLS 430 ® Carbon |
| 2 | Eastman Kodak HX ® Toner-Black | Cabot BLACK PEARLS 430 ® Carbon |
| 3 | Eastman Kodak HX ® Toner-Blue | BASF HELIOGEN BLUE K7090 ® |
| 4 | Eastman Kodak HX ® Toner-Red | Mixture of BASF LITHOL SCARLET D4461 ® BASF PALIOTOL YELLOW K1841D ® |
| 5 | Eastman Kodak HX ® Toner-Green | BASF HELIOGEN GREEN K9360 ® |
| 6 | Eastman Kodak HX ® Toner-Yellow | BASF PALIOTOL YELLOW K1841D ® |
| 7 | Eastman Kodak HX ® Toner-Brown | Mixture of BASF PALIOTOL YELLOW K1841D ® BASF HELIOGEN BLUE K7090 ® BASF LITHOL SCARLET Cabot BLACK PEARLS 430 ® Carbon |
| 8 | Eastman Kodak COLOREDGE ® Cyan Toner | Bridged Aluminum Phtalocyanine |
| 9 | US Ser. No. 08/253,447, filed 08 June 1994 and entitled HUMIDITY STABIILZED TONERS AND DEVELOPERS (now abandoned) | Cabot BLACK PEARLS 430 ® Carbon |

TABLE 2

| | Carrier Core | Conductive Coating Material | Amount |
|---|---|---|---|
| 1 | Strontium based hard ferrite coated with 0.94 pph and 0.56 pph PMMA | None | None |
| 2 | Same as above | Lauramidopropyltrimethyl ammonium methyl sulfate | 200 ppm |

TABLE 2-continued

| | Carrier Core | Conductive Coating Material | Amount |
|---|---|---|---|
| 3 | Same as above | Lauramidopropyltrimethyl ammonium methyl sulfate | 300 ppm |
| 4 | Same as above | Cetyl pyridinium chloride | 200 ppm |
| 5 | Same as above | Cetyl pyridinium chloride | 300 ppm |
| 6 | Same as above | Stearamidopropyldimethyl-β-hydroxyethyl ammonium nitrate | 200 ppm |
| 7 | Same as above | Dioctadecyldimethyl ammonium chloride | 200 ppm |
| 8 | Same as above | octadecyl dimethyl benzyl ammonium chloride | 200 ppm |
| 9 | Same as above | Dodecylbenzyl dimethyl ammonium 3-nitrobenzene sulfonate | 200 ppm |
| 10 | Strontium based hard ferrite coated with 2.00 pph PMMA | None | None |
| 11 | Strontium based hard ferrite coated with 2.00 pph PMMA | Lauramidopropyltrimethyl ammonium methyl sulfate | 100 ppm |
| 12 | Strontium based hard ferrite coated with 2.00 pph PMMA | Lauramidopropyltrimethyl ammonium methyl sulfate | 200 ppm |

Table 3 shows that, by coating the carrier particles with the indicated amount of organic conductive material, the more stable developer performance in terms of its charge to mass ratio stability is achieved. Further, the formation of "wrong signed" toner particles is substantially completely eliminated. These wrong signed particles, formed as a result of unreplenished aging of the developer, usually results in "dusting" which in turn results in machine contamination and copy background defects.

The invention has been described in detail with particular reference to preferred embodiments thereof, but it will be understood that variations and modifications can be effected within the spirit and scope of the invention.

We claim:

1. A carrier for an electrostatographic developer, said carrier comprising:

particles of a hard magnetic ferrite material as the core and having a coating of a thermoplastic polymer resin selected from the group consisting of poly(vinylidene fluoride), poly(vinylidene fluoride-co-tetrafluoroethylene), and a mixture of poly(vinylidene fluoride) and poly(methyl methacrylate), said particles in turn having an outermost layer comprising a conductive charge control agent selected from the group consisting of lauramidopropyl trimethylammonium

TABLE 3

| Ex. | Toner | Carrier | Fresh Q/M (μC/g) | 10 min ex. Q/M (μC/g) | 1 hour ex. Q/M (μC/g) | % TC Wrong-signed @ 10 min ex. | % TC Wrong-signed @ 1 hr ex. |
|---|---|---|---|---|---|---|---|
| C1 | 1 | 1 | 17.4 | 5.7 | Negative | 13.0 | 100.0 |
| 1 | 1 | 2 | 20.4 | 14.3 | 4.9 | None | None |
| 2 | 1 | 3 | 19.5 | 15.4 | 12.1 | None | None |
| C2 | 2 | 1 | 13.0 | 5.0 | Negative | 53.0> | 100.0 |
| 3 | 2 | 2 | 22.2 | 18.3 | 9.0 | None | None |
| 4 | 2 | 3 | 15.0 | 14.0 | 19.0 | None | None |
| 5 | 2 | 4 | 23.0 | 27.0 | 25.0 | None | None |
| 6 | 2 | 5 | 27.9 | 28.0 | 24.4 | None | None |
| 7 | 2 | 7 | 38.0 | 47.0 | 32.0 | None | None |
| 8 | 2 | 9 | 27.6 | 23.8 | 14.6 | None | None |
| C3 | 3 | 1 | 9.0 | 5.0 | Negative | 4.0 | 97 |
| 10 | 3 | 2 | 28.8 | 18.0 | 7.9 | None | None |
| 11 | 3 | 3 | 21.7 | 19.3 | 16.3 | None | None |
| 12 | 3 | 4 | 19.0 | 27.0 | 27.0 | None | None |
| 13 | 3 | 7 | 36.0 | 44.0 | 15.0 | None | None |
| C4 | 4 | 1 | 19.9 | Negative | Negative | 99.7 | 100.0 |
| 14 | 4 | 2 | 25.4 | 16.3 | 9.0 | None | None |
| 15 | 4 | 3 | 22.1 | 15.0 | 9.5 | None | None |
| 16 | 4 | 5 | 21.4 | 16.2 | 7.3 | None | None |
| 17 | 4 | 6 | 11.5 | 9.9 | 9.0 | None | None |
| 18 | 4 | 7 | 33.6 | 31.0 | 18.1 | None | None |
| 19 | 4 | 8 | 20.6 | 17.2 | 13.0 | None | None |
| 20 | 4 | 9 | 28.6 | 19.9 | 14.1 | None | None |
| C5 | 5 | 1 | 23.5 | 1.9 | Negative | 25.0 | 100.0 |
| 21 | 5 | 2 | 29.1 | 23.7 | 20.8 | None | None |
| 22 | 5 | 3 | 26.8 | 24.3 | 24.0 | None | None |
| 23 | 5 | 5 | 25.6 | 22.2 | 10.8 | None | None |
| C6 | 6 | 1 | 27.2 | 6.6 | Negative | 7.0 | 99.4 |
| 24 | 6 | 2 | 24.7 | 21.5 | 16.1 | None | None |
| 25 | 6 | 3 | 21.5 | 20.6 | 18.0 | None | None |
| 26 | 6 | 5 | 19.4 | 15.5 | 8.9 | None | None |
| C7 | 7 | 1 | 24.4 | 1.1 | Negative | 57.0 | 100.0 |
| 27 | 7 | 2 | 25.3 | 20.5 | 15.9 | None | None |
| 28 | 7 | 3 | 22.8 | 19.4 | 18.0 | None | None |
| 29 | 7 | 5 | 24.5 | 18.3 | 9.4 | None | None |
| C8 | 8 | 1 | 17.3 | 2.6 | Negative | 22.1 | 100.0 |
| 30 | 8 | 3 | 13.3 | 4.6 | 2.3 | None | 20.8 |
| C9 | 9 | 10 | −40.9 | −36.5 | | 15.0 | |
| 31 | 9 | 11 | −25.3 | −21.9 | | None | |
| 32 | 9 | 12 | −11.2 | −15.0 | | 9.0 | |

methylsulfate, cetyl pyridinium chloride, and dioctadecyl dimethyl ammonium chloride; wherein said outernost layer is formnnd by a process consisting essentially of the steps of coating said resin coating with a solution in a solvent of said conductive charge control agent, and then removing said solvent.

2. The carrier according to claim 1 wherein the amount of conductive charge control agent ranges from about 50 to 500 ppm by weight of the combined hard magnetic ferrite material and polymer resin coating.

3. The carrier according to claim 2 wherein the amount of conductive charge control agent is between about 200 ppm and 350 ppm by weight of the combined hard magnetic ferrite material and polymer resin coating.

4. The carrier of claim 1 wherein the hard magnetic ferrite material has crystalline structure that exhibits a coercivity of at least 300 Oersteds when magnetically saturated and an induced magnetic moment of at least EMU/g when in an applied magnetic field of 1000 Oersteds and having a number average particle diameter of from 10.0 to 38.0 micrometers.

5. The carrier of claim 1 wherein said hard ferrite magnetic material has a coercivity of about 1000 to 3000 Oersteds when magnetically saturated and an induced magnetic moment of about 30 to 70 EMU/g in an applied field of 1000 Oersteds.

6. The carrier of claim 1 wherein said hard maignetic ferrite material comprises a strontium ferrite material.

7. The carrier of claim 1 wherein said solvent in said solution of said charge control agent is selected from the group consisting of methanol, isopropyl alcohol, and water.

8. The carrier of claim 7 wherein said solvent is removed from said outermost layer by evaporation.

9. The carrier of claim 1 wherein said polymer resin coating is polyvinylidene fluoride, or a mixture of polyvinylidene fluoride and poly(methylmethacrylate).

10. An electrcostatographic two-component dry developer composition for use in the development of electrostatic latent images which comprises a mixture of charged toner and oppositely charged carrier according to claim 1.

11. The electrcostatographic developer of claim 10 comprising from about 75 to about 99 weight percent of the carrier and from about 1 to about weight per cent of the toner.

* * * * *